US006857488B2

(12) United States Patent
Pastor

(10) Patent No.: US 6,857,488 B2
(45) Date of Patent: Feb. 22, 2005

(54) BORING HEAD CUTTER

(75) Inventor: Robert X. Pastor, 12059 Crestwood Rd., Newbury, OH (US) 44065

(73) Assignee: Robert X. Pastor, Newbury, OH (US)

( * ) Notice: Subject to any disclaimer, the term of this patent is extended or adjusted under 35 U.S.C. 154(b) by 10 days.

(21) Appl. No.: 10/356,058

(22) Filed: Jan. 31, 2003

(65) Prior Publication Data

US 2004/0150257 A1 Aug. 5, 2004

(51) Int. Cl.[7] ..... E21B 10/10
(52) U.S. Cl. ..... 175/373; 175/378; 175/351
(58) Field of Search ..... 175/371, 367, 175/373, 374, 378, 53, 351, 364, 369

(56) References Cited

U.S. PATENT DOCUMENTS

| | | | | | |
|---|---|---|---|---|---|
| 17,660 | A | | 6/1857 | Wilson | |
| 1,320,144 | A | | 10/1919 | Hencken | |
| 2,234,197 | A | | 3/1941 | Reed | |
| 3,041,055 | A | | 6/1962 | Risse | |
| 3,598,445 | A | * | 8/1971 | Winberg | 299/31 |
| 4,161,225 | A | * | 7/1979 | Mitchell | 175/374 |
| 4,189,186 | A | * | 2/1980 | Snyder | 299/31 |
| 4,202,419 | A | | 5/1980 | Youngblood | |
| 4,274,496 | A | | 6/1981 | Liljekvist et al. | |
| 4,371,211 | A | * | 2/1983 | Snyder | 299/11 |
| 4,393,949 | A | | 7/1983 | Peterson | |
| 4,549,614 | A | | 10/1985 | Kaalstad et al. | |
| 4,751,972 | A | | 6/1988 | Jones et al. | |
| 4,762,188 | A | | 8/1988 | Masse | |
| 5,125,719 | A | * | 6/1992 | Snyder | 299/31 |
| 5,421,422 | A | * | 6/1995 | Crane et al. | 175/363 |
| 5,456,328 | A | | 10/1995 | Saxman | |
| 5,598,895 | A | | 2/1997 | Anderson et al. | |
| 5,961,185 | A | * | 10/1999 | Friant et al. | 299/33 |

* cited by examiner

*Primary Examiner*—Frank Tsay
(74) *Attorney, Agent, or Firm*—Watts Hoffmann Co., LPA

(57) ABSTRACT

A tunnel boring including a rotatable head is disclosed. The head has a cutting face transverse to a head axis of rotation. A plurality of cutters are mounted in the face each on an associated one of a plurality of hubs. The hubs mounted for rotation about a respective hub axes. Each such respective hub axis is in an imaginary plane intersecting another imaginary plane including the head axis. Each of the cutters has a cutting edge symmetrical about another imaginary plane which is skewed with respect to the respective hub axis of the associated hub.

15 Claims, 4 Drawing Sheets

BORING HEAD CUTTER

This invention relates to tunnel boring equipment and more particular to an improved cutter for cutting tunnel head walls and a process of cutting such head walls.

BACKGROUND OF THE INVENTION

Large tunnels for subways, mining and highway are made with tunnel boring equipment. A typical tunnel boring machine includes a large diameter cutter head of a diameter only slightly less than the diameter of a tunnel being bored. The head is rotatively mounted on a machine body which in turn is mounted on wheels for advance as the head is rotated. Conveyors behind the head transport cuttings rearwardly for removal from the tunnel.

The cutter head carries a plurality of cutters. In the past such cutters have been fixedly and coaxially mounted on hubs for rotation about the hub and cutter axis. Cutter rotation is caused by frictional engagement of each cutter with the head wall as the boring head is advanced and rotated.

Boring a tunnel is a very slow and time consuming procedure. Accordingly it would be desirable to provide improved cutters which would reduce the time consumed in boring a tunnel.

SUMMARY OF THE INVENTION

The present invention is embodied in improved hub mounted cutters. Each of the improved cutters has a cutting edge disposed within or located symmetrically about an imaginary plane which intersects the axis of the hub on which the cutter is mounted at an acute angle. That angle in the disclosed embodiments is of the order of 75 degrees with its hub's axis at the maximum cutter inclination with respect to the hub axis.

In one embodiment the cutting edge is a circle such that as the hub rotates when the cutter is in use penetration of the head wall being bored varies due to the skewed mounting of a blade's cutting edge on the hub. Thus, the blade engages the head wall in a scalloped pattern.

Expressed another way motion a the blade's cutting edge relative to the axis of its hub has reciprocating vectors both parallel and normal to the hub axis. This cutter edge motion relative to the hub axis coupled with the boring head rotation causing the cutters to orbit the head axis produces impacting pressure on the head wall that results in enhanced boring speeds.

With a second embodiment of the cutter the blade is elliptical with the major dimension being in an imaginary plane which includes the axis of hub rotation and which angularly bisects the blade such that the scalloping action is more pronounced with the eccentric configuration. Expressed another way, the reciprocating vector normal to the hub axis is enhanced.

Thus, in both embodiments the skewed mounting of the blade results in an impacting of the head wall tending to enhance the fracturing of the wall and accelerate the boring action especially when the material being bored is a relatively hard rock.

DETAILED DESCRIPTION

Figure 2:
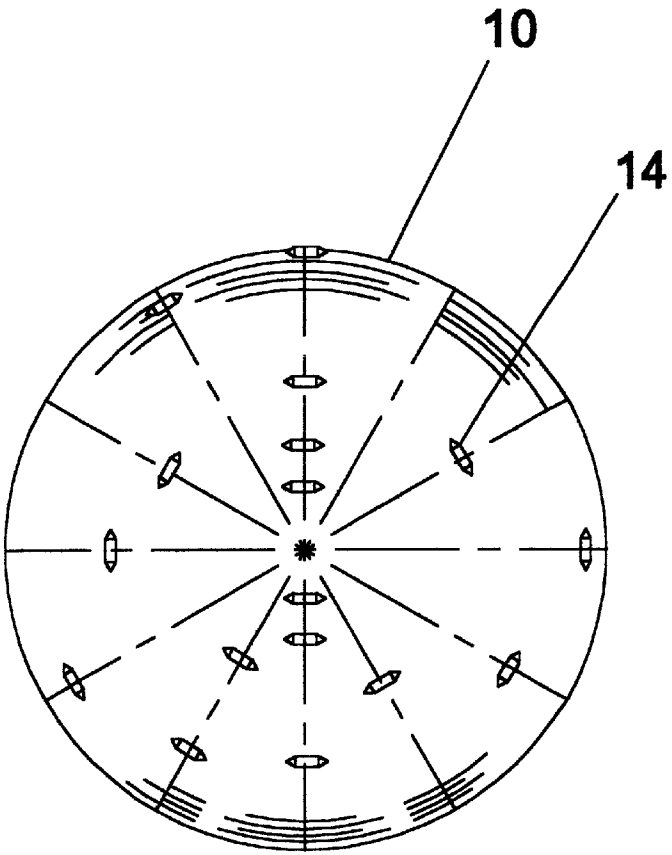
FIG. 2 is an end elevation view of the cutter head.
Figure 1:
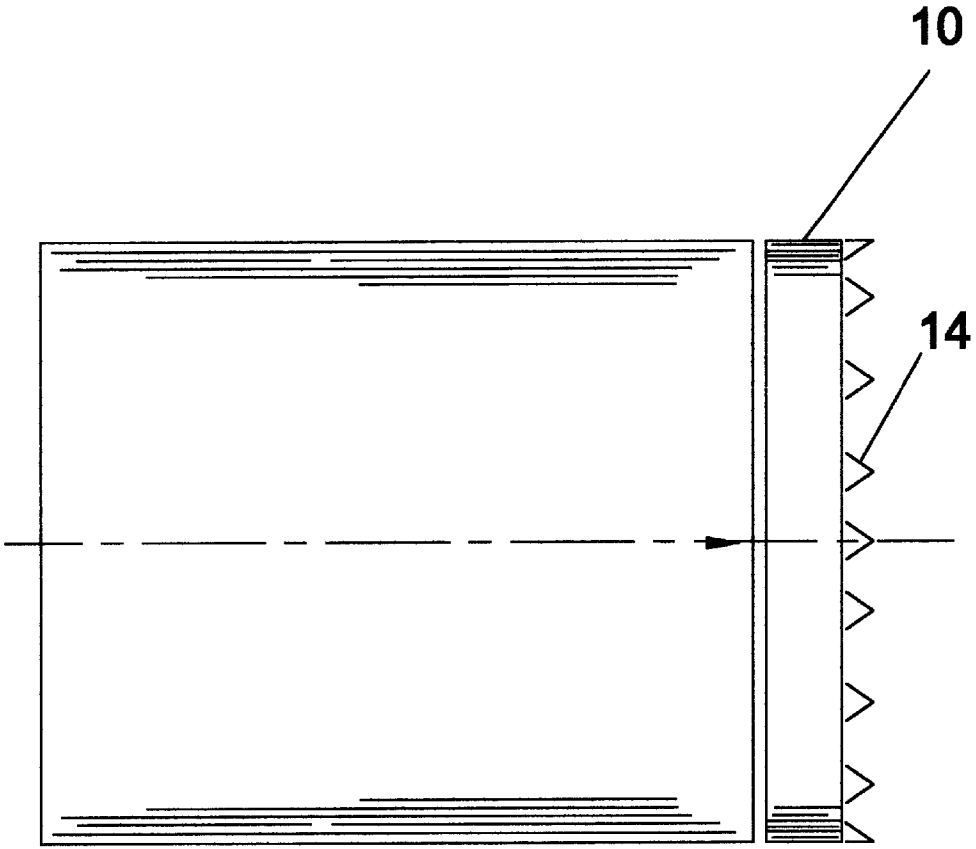
FIG. 1 is a side elevational view of a cutter machine body, a cutter head with cutters projecting from the face of the head.

Referring to the drawings a cutter head is shown somewhat schematically at 10 in FIGS. 1 and 2. The cutter head 10 is rotatively mounted on a cutter body 12. The head 10 will be of a diameter only slightly less than the diameter of the tunnel being formed so that cutters mounted on it can cut the head wall to a diameter slightly larger than the cutter head to produce a tunnel of the size desired.

Figures 3A, 3B:
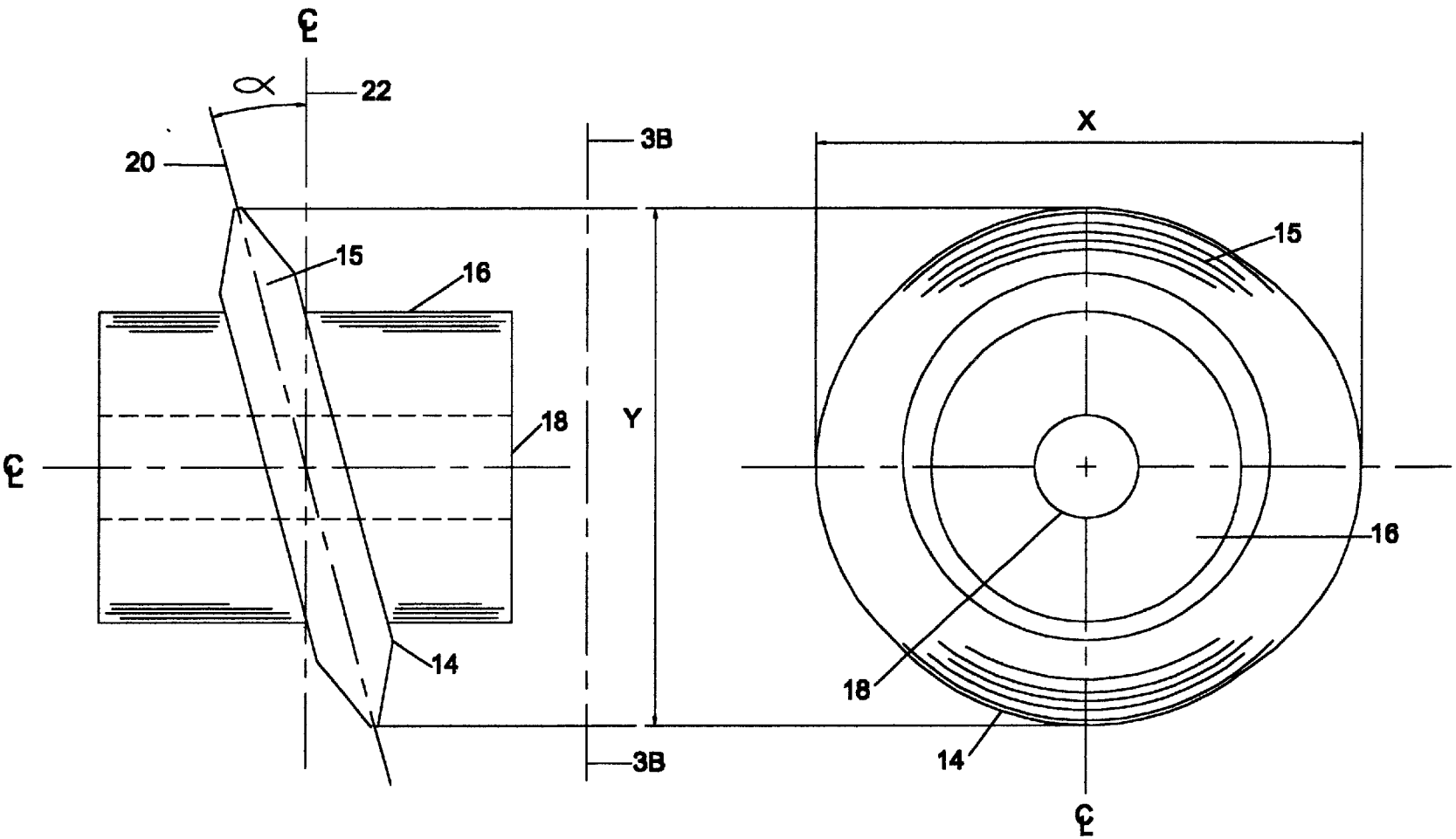
FIG. 3A is a side elevational view of the cutter and hub of the elliptical embodiment.
FIG. 3B is an end elevational view of the embodiment of FIG. 3A.

Referring now to FIGS. 3A and 3B one of the cutters 14 of the embodiment in which a cutter blade 15 is elliptical is shown on an enlarged scale with respect to FIGS. 1 and 2. The cutter 14 is mounted on a cutter hub 16. The hub 16 has a bore 18 for mounting the cutter and hub on the cutter head 10. As is best seen in FIG. 3A the blade 15 defines a cutting edge 20 which lies in an imaginary plane. The angle between the planes of the cutting edge 20 and a center line 22 is 15 degrees. Expressed another way, the imaginary plane of the cutting edge 20 when viewed in the plane of FIG. 3A, intersects the hub axis at approximately 75 degrees. The angle of that intersection is preferably in a range less than 90 degrees with the preferred angle being a variable depending on the type of the material being bored. It should be recognized that in a plane perpendicular to the hub axis and located by the center line of FIG. 3A a radius of the cutter 15 is perpendicular to the hub axis.

As can be seen from an examination of FIG. 3B, the blade is elliptical with the major axis of the ellipse being in a plane including the hub axis and a plane normal to the hub axis plane and intersecting the blade at its center. The minor axis is normal to the major axis and in a plane paralleling the plane of FIG. 3B and bisecting the cutter.

Figures 4A, 4B:
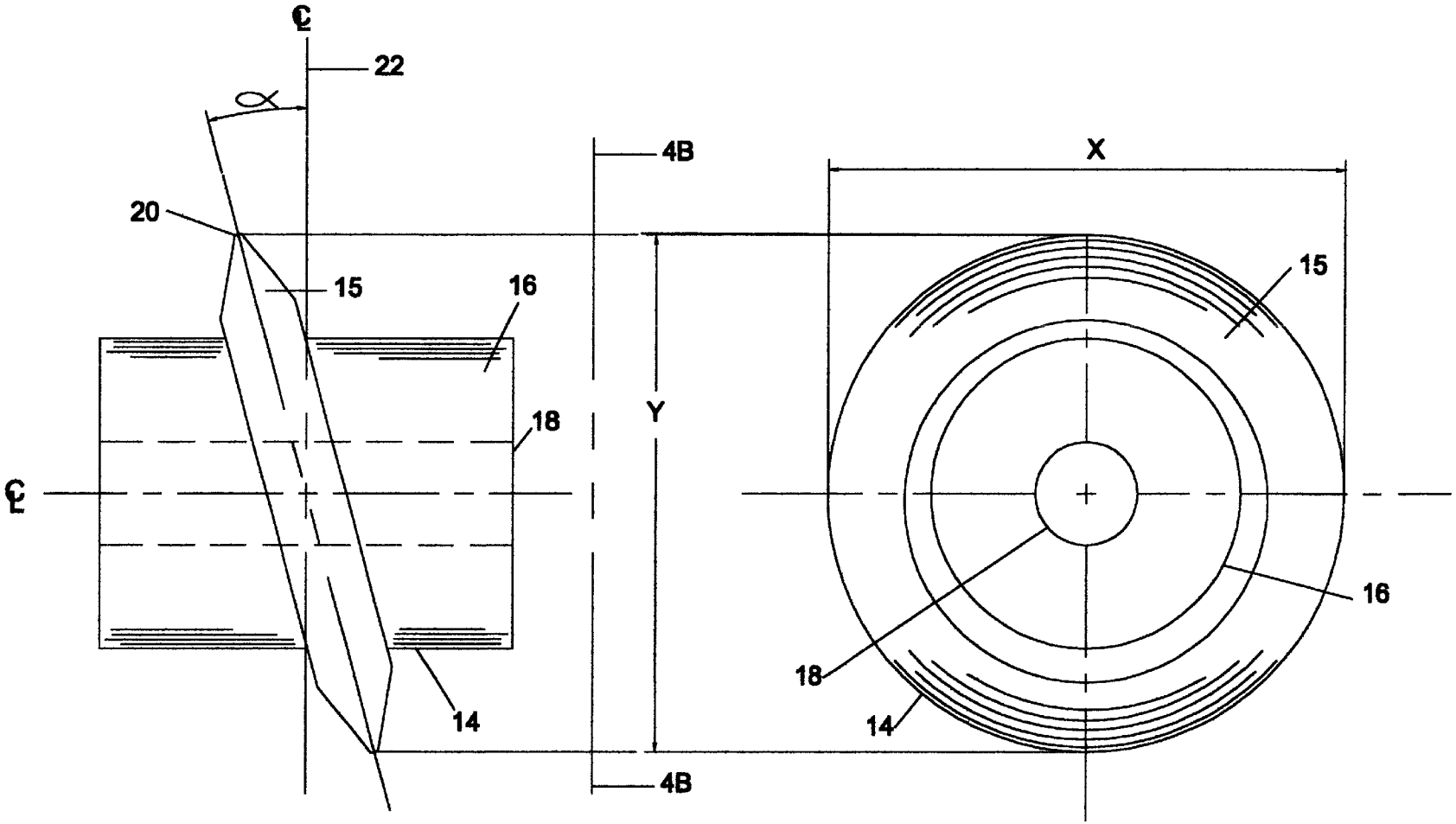
FIG. 4A is a side elevational view on the scale of FIGS. 3A and 3B of the concentric embodiment.
FIG. 4B is an end elevational view of the embodiment of FIG. 4A.

By contrast, the blade of FIGS. 4A and 4B is concentric in a plane bisecting the cutter which is the plane of the cutting edge 20'. In the drawings both embodiments are shown at 75 degrees with the hub axis. In the disclosed and illustrative embodiments 75 degrees is the maximum angle of inclination of the cutting edge relative to the hub axis such that the points of contact of the cutting edge as the cutter is rotated produce an arc ranging from 75 degrees to one side of perpendicular to 75 degrees to the other side.

Operation

In operation, the head and body 10, 12 are advanced until the cutters 14 are positioned to commence to engage the head wall to be bored. The head 10 is then caused to rotate about its axis while thrust, to the right as viewed in FIG. 1, is applied to force the cutters against a head wall being bored.

Prior to positioning the boring head 10 adjacent the head wall, cutters made in accordance with the present invention and having optimized skewing and eccentricity or concentricity for the material to be bored will be mounted in the boring head. Thus an operator will determine the type of the material to be bored and use cutters which tests have shown to have optimized amounts of skewing and eccentricity.

Figure 5:
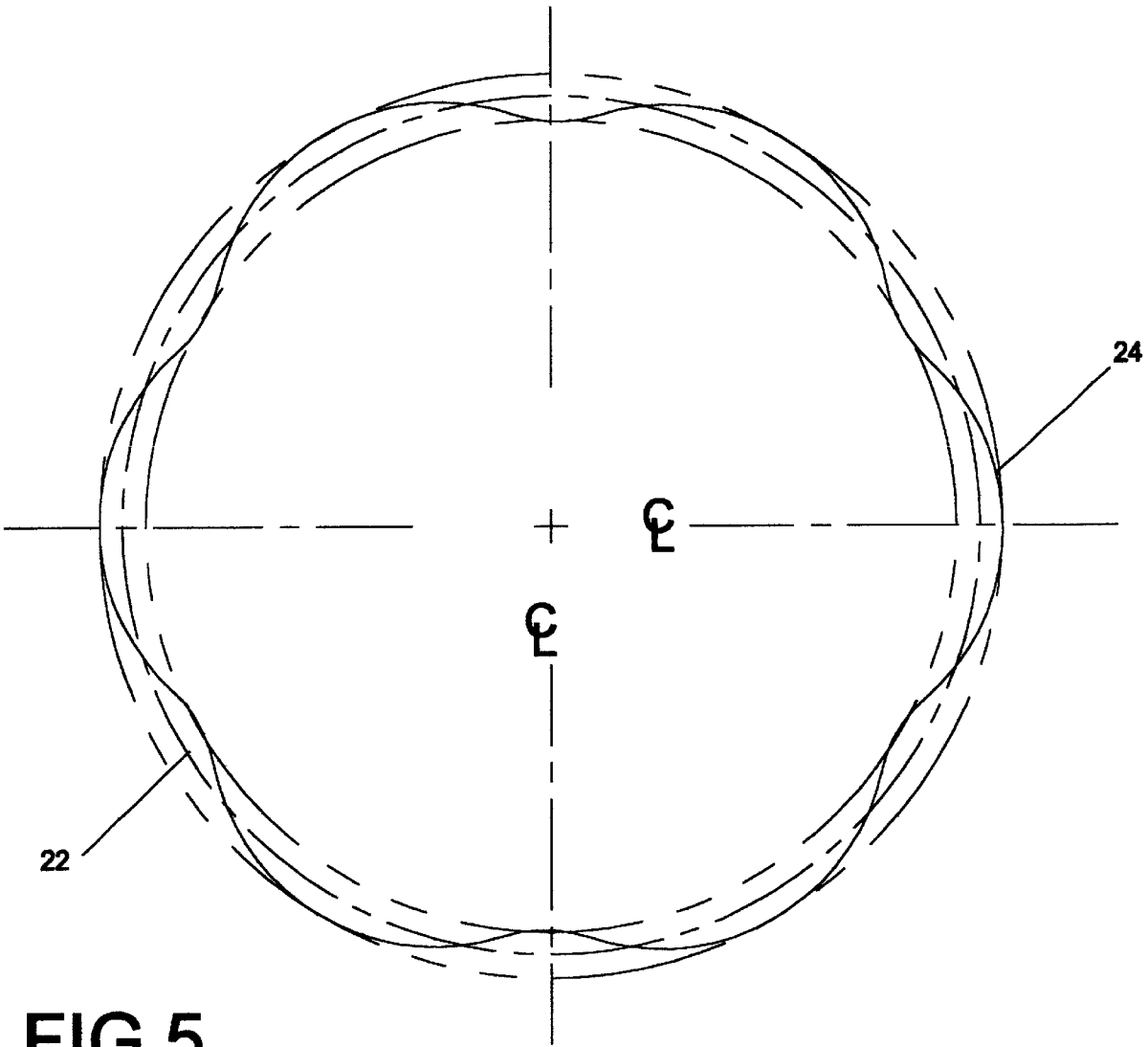
FIG. 5 is a schematic showing of the cutting action of the improved cutter blades of the present invention.

As the boring head is advanced and rotated to apply pressure to the head wall, friction of the cutters against the head wall being bored will cause the cutters to rotate about their respective hub axes. As we have described this rotation will cause the cutting edges 20 to produce cutting vectors which are both parallel to the axis of a cutter's hub and normal to it. The result is a scalloping cutting action illustrated by the solid line 24 of FIG. 5. Forces imparted by the cutters tend to both compress and shear the head wall resulting in fracturing as well as cutting away material from the head wall. The combination of enhanced cutting and fracturing of the head wall results in enhanced boring speed.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

I claim:

1. In a tunnel boring apparatus the improvement comprising:

a) a head having a cutting face;

b) the head being rotatable about a head axis, the head axis being transverse to the face;

c) a plurality of cutters each mounted on an associated one of a plurality of hubs;

d) the hubs and associated cutters each being mounted on the head for rotation about a respective hub axis;

e) each such respective hub axis being generally radial of the head; and, f) each of the cutters having a cutting edge being symmetrical about an associated imaginary plane which is skewed with respect to the respective hub axis of the associated hub.

2. The apparatus of claim 1 wherein the said cutters and associated hubs are caused to rotate in use by frictional engagement of the cutters with a head wall of a tunnel being bored.

3. The apparatus of claim 2 wherein each said rotatively mounted cutter engages such head wall in a scallop pattern when the apparatus is in use.

4. The apparatus of claim 1 wherein each said rotatively mounted cutter engages such head wall in a scallop pattern when the apparatus is in use.

5. The apparatus of claim 1 wherein at least some of the each cutting edge imaginary planes are intersected by the respective hub axes each at an angle other than normal.

6. The apparatus of claim 5 wherein each said cutting edges is eccentric about the intersection of its imaginary plane by its respective hub axis.

7. The apparatus of claim 6 wherein each said rotatively mounted cutter engages a head wall in a scallop pattern when the apparatus is in use.

8. The apparatus of claim 5 wherein each of said cutting edges is concentric about the intersection of its imaginary plane by its respective hub axis.

9. The apparatus of claim 8 wherein each said rotatively mounted blade engages a head wall in a scallop pattern when the apparatus is in use.

10. A cutter device for use in boring earth, the device comprising:

a) a hub adapted to be mounted and rotated about a hub axis;

b) a cutter blade carried by the hub;

c) the blade including a peripheral cutter edge disposed in an imaginary cutter plane; and, d) the cutter plane being intersected by the hub axis at an angle other than perpendicular.

11. The device of claim 10 wherein the cutter edge is circular.

12. The device of claim 10 wherein the cutter edge is an ellipse.

13. The device of claim 10 wherein the hub axis intersects the cutter plane at an angle of about 75 degrees.

14. A process of boring a tunnel with hub mounted cutters each having cutting edges locating a respective cutter plane intersected at an angle other than perpendicular by an axis of the hub mounting that cutter, the process comprising:

a) mounting the hubs in the face of a boring head for rotation relative to the head;

b) bringing the cutters into engagement with a tunnel head wall, c) rotating the head about a head axis while concurrently applying an advancing force to the head to maintain at least some of the cutters in boring contact with the head wall; and, d) the head rotation and force advancement causing at least some of the cutters to rotate about respective hub axes whereby the cutters impact the wall in a pulsating action.

15. The process of claim 14 wherein at least some of the hub axes are in respective imaginary planes normal to the head axis of rotation.

* * * * *